US006862896B1

(12) United States Patent
Seidl

(10) Patent No.: US 6,862,896 B1
(45) Date of Patent: Mar. 8, 2005

(54) COOLER CHEST AND CAN DISPENSING STRUCTURE

(76) Inventor: Richard J. Seidl, 5016 Webster St., Omaha, NE (US) 68132

( * ) Notice: Subject to any disclaimer, the term of this patent is extended or adjusted under 35 U.S.C. 154(b) by 0 days.

(21) Appl. No.: 10/628,592

(22) Filed: Jul. 28, 2003

(51) Int. Cl.[7] ..... F25D 3/08; A47J 39/00

(52) U.S. Cl. ..... 62/457.4; 62/457.7; 62/371; 220/592.16

(58) Field of Search ..... 62/457.5, 457.3, 62/457.7, 457.4, 389, 464, 371; 220/592.02, 592.16, 739, 459.03; 221/97

(56) References Cited

U.S. PATENT DOCUMENTS

| | | | | |
|---|---|---|---|---|
| 3,106,074 | A | 10/1963 | AMburgey, Jr. | 62/464 |
| 3,395,550 | A | 8/1968 | Dungan | 62/400 |
| 4,194,647 | A | 3/1980 | Spurrier | 221/97 |
| 4,510,770 | A | 4/1985 | Vella | 62/464 |
| 4,721,237 | A | 1/1988 | Leslie | 224/148 |
| 4,899,904 | A | 2/1990 | Dooley et al. | 220/413 |
| 5,295,369 | A | 3/1994 | Garcia | 62/389 |
| 6,026,978 | A | 2/2000 | Clegg et al. | 220/592.1 |
| 6,109,059 | A | 8/2000 | Lebrun | 62/457.5 |
| D433,285 | S | 11/2000 | Camp, Jr. | D7/605 |
| 6,173,582 | B1 * | 1/2001 | Hixson | 62/457.4 |

* cited by examiner

*Primary Examiner*—Chen Wen Jiang
(74) *Attorney, Agent, or Firm*—Thomte, Mazour & Niebergall; Dennis L. Thomte

(57) ABSTRACT

A cooler chest and can dispensing structure is described for individually dispensing cans therefrom. The structure comprises a cooler chest having a can dispensing structure positioned in the cooler compartment which extends between the opposite ends of the cooler chest. The can dispensing structure is sealed from the interior of the cooler chest to prevent ice and water therein from coming into contact with the cans.

1 Claim, 7 Drawing Sheets

COOLER CHEST AND CAN DISPENSING STRUCTURE

BACKGROUND OF THE INVENTION

1. Field of the Invention

This invention relates to a cooler chest and more particularly to a cooler chest having a can dispensing structure included therewith which is operable to individually dispense cooled beverage cans therefrom.

2. Description of the Related Art

Many types of cooler chests have been provided which include some means for cooling beverage cans and to dispense the same therefrom once they are cooled. Although some of the prior art cooler chests and can dispensing structures have met with some success, it is believed that the prior art devices with which applicant is familiar lack certain features or possess certain disadvantages. In some of the prior art cooler chests having beverage can dispensers associated therewith, the lid of the cooler chest must be opened to insert beverage cans into the chest and to remove the cooled cans therefrom. Further, certain of the prior art cooler chests and beverage can dispensers permit ice and water in the chest, which may be contaminated, to contact the beverage cans in the cooler compartment. Still other prior art cooler chests with can dispensers associated therewith are simply not convenient to use. Additionally, it is difficult to clean some of the prior art beverage can cooling chests and dispensers should the beverage can leak while in the cooler chest.

SUMMARY OF THE INVENTION

A cooler chest and can dispenser structure is disclosed which is operable to individually dispense cooled beverage cans therefrom. The structure includes a cooler chest having a bottom wall, upright spaced-apart first and second side walls, and upright spaced-apart first and second end walls which define a cooler compartment which is selectively closed by a lid member. The first end wall of the cooler chest has a generally horizontally disposed first rectangular opening formed therein below the upper end thereof. The first rectangular opening is selectively closeable. The second end wall of the cooler chest has a generally horizontally disposed second rectangular opening formed therein above the lower end thereof. The second rectangular opening is selectively closeable. A can dispenser structure is positioned in the cooler compartment which extends between the first and second end walls of the cooler chest. The can dispenser structure has a can receiving end in sealed communication with the first rectangular opening and has a can dispensing end in sealed communication with the second rectangular opening. The can dispenser structure includes a can cooling compartment which is sealed from the cooler compartment of the cooler chest so that ice and water in the cooler compartment cannot enter the can cooling compartment of the can dispenser structure.

The can receiving end of the can dispenser structure is positioned above the can dispensing end of the can dispenser structure so that the cans within the can dispenser structure will roll from the can receiving end to the can dispensing end of the can dispenser structure.

The can receiving end of the can dispenser structure is sealed with respect to the first rectangular opening to prevent ice and water in the cooler compartment from entering the can dispenser structure and to prevent ice and water in the cooler compartment from passing outwardly through the first rectangular opening. The can dispensing end of the can dispenser structure is sealed with respect to the second rectangular opening to prevent ice and water in the cooler compartment from entering the can dispenser structure and to prevent ice and water in the cooler compartment from passing outwardly through the second rectangular opening. The can dispensing end of the can dispenser structure includes a pivotal gate structure which permits the dispensing of a single can at a time.

It is therefore a principal object of the invention to provide an improved cooler chest and can dispenser structure which is operable to individually dispense cooled beverage cans therefrom.

Yet another object of the invention is to provide a cooler chest having a can dispenser structure therein which may be filled and which may dispense cool cans therefrom without opening the lid of the cooler chest associated therewith.

Yet another object of the invention is to provide a cooler chest and can dispenser structure which prevents ice and water within the cooler chest from coming into contact with the beverage cans being cooled.

Still another object of the invention is to provide a cooler chest and can dispenser structure which includes means for preventing ice and water from the cooler chest from passing outwardly through the can receiving end and the can dispensing end of the can dispenser structure.

Still another object of the invention is to provide a cooler chest and can dispenser structure which is easy to clean should a beverage can leak while in the can dispenser structure.

These and other objects will be apparent to those skilled in the art.

DESCRIPTION OF THE PREFERRED EMBODIMENT

Figure 1:
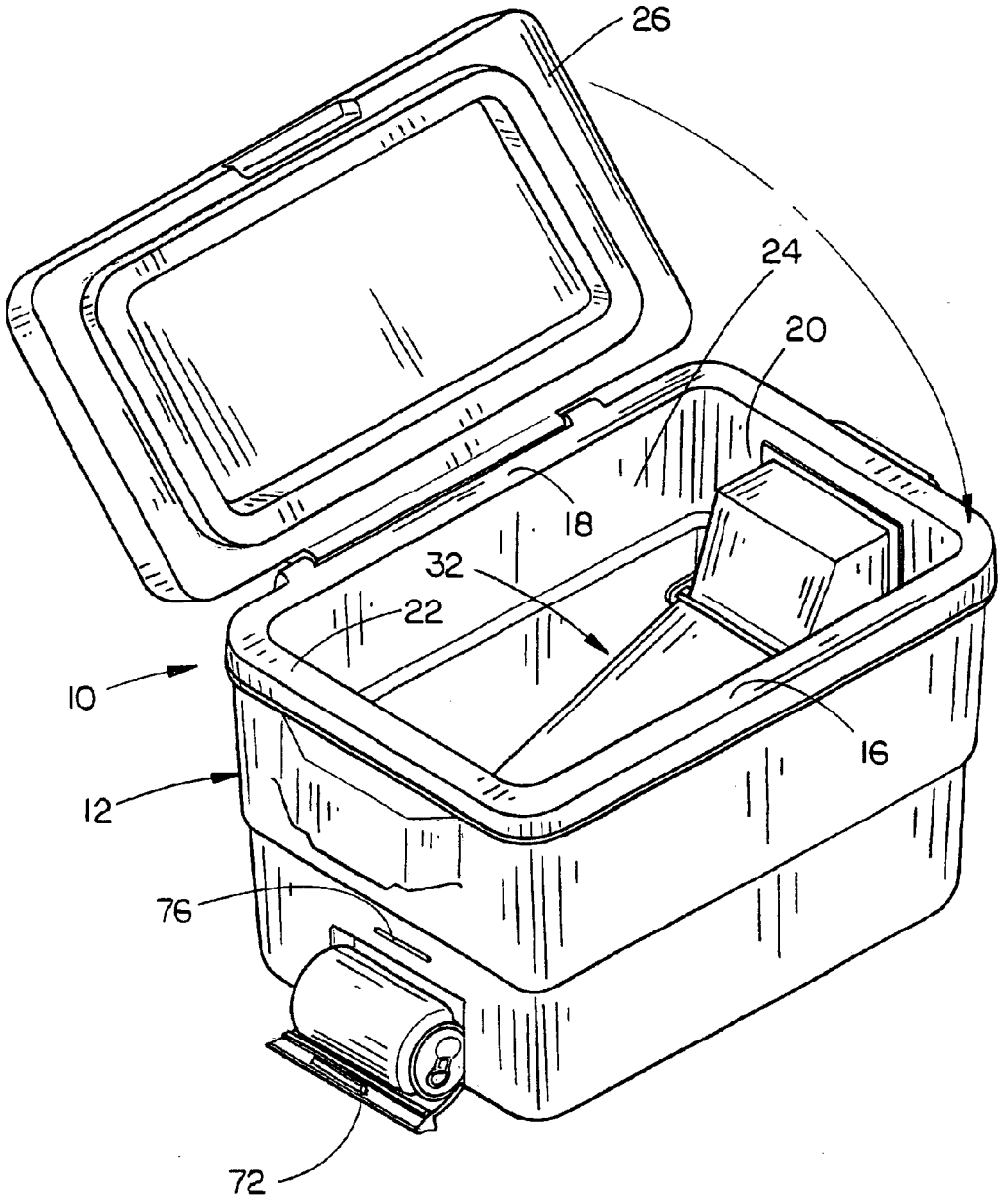
FIG. 1 is a perspective view of the cooler chest and can dispensing structure of this invention with the cover of the chest in an open position to illustrate the invention.
Figure 2:
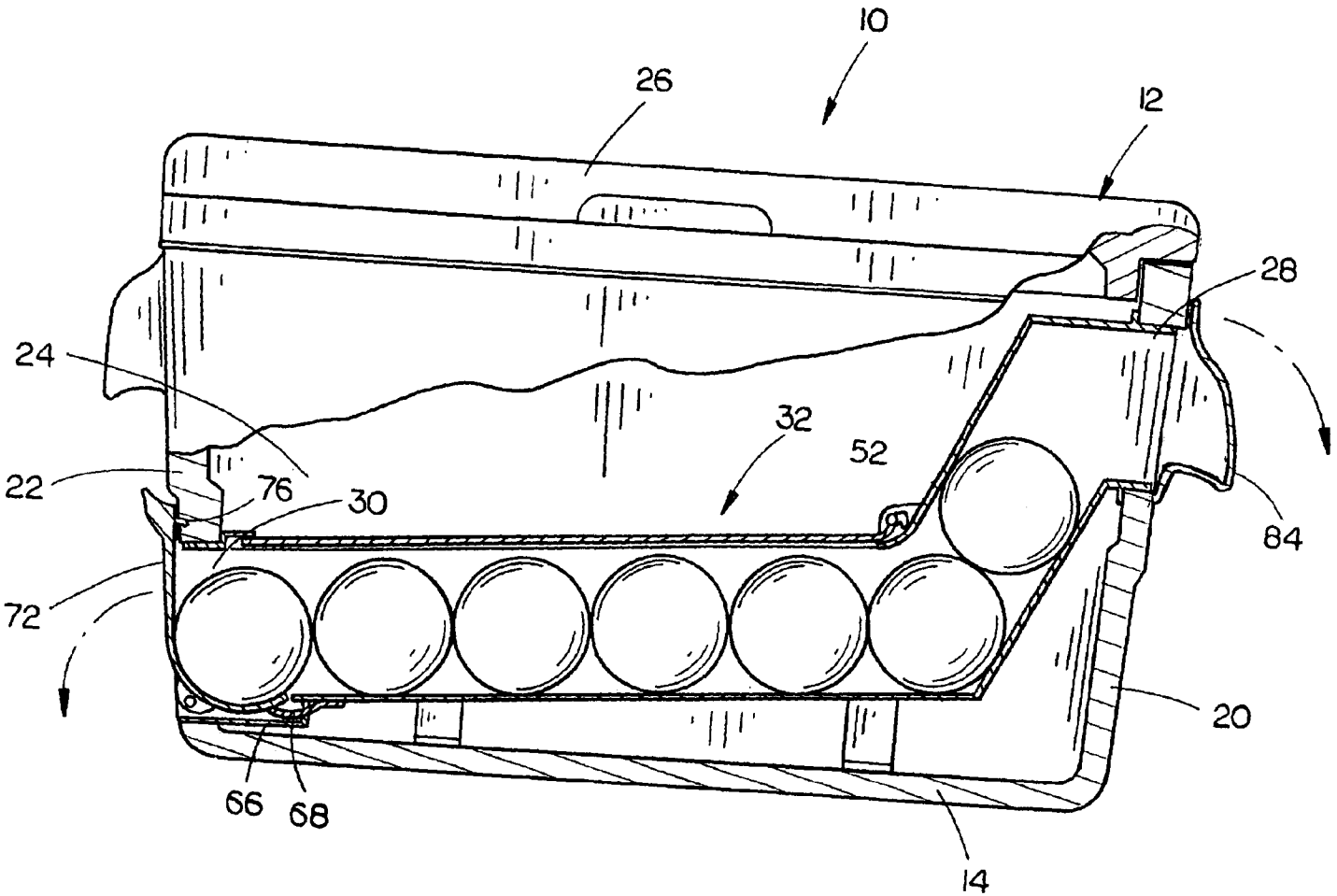
FIG. 2 is a side view of the cooler chest and can dispensing structure of this invention with portions thereof cut away to more fully illustrate the invention.

The numeral 10 refers generally to the cooler chest and can dispenser structure of this invention. Structure 10 includes a cooler chest 12 having a bottom wall 14, first and second upstanding side walls 16 and 18, and upstanding end walls 20 and 22 which define a cooler compartment 24 which is selectively closeable by a cover or lid 26.

End wall 20 has a generally horizontally disposed first rectangular opening 28 formed therein above the lower end thereof, as seen in the drawings. End wall 22 has a generally horizontally disposed second rectangular opening 30 formed therein above bottom wall 14, as also seen in the drawings. The numeral 32 refers to the can dispensing structure of this invention which extends between the openings 28 and 30. Structure 32 is preferably formed of a plastic material and includes a can receiving end 34 which is in communication with opening 28 and a can dispensing end 36 which is in communication with opening 30. Structure 32 includes a chute portion 38 which extends downwardly and inwardly from can dispensing end 34 to the main body portion 40 of the structure 32.

Figure 3:
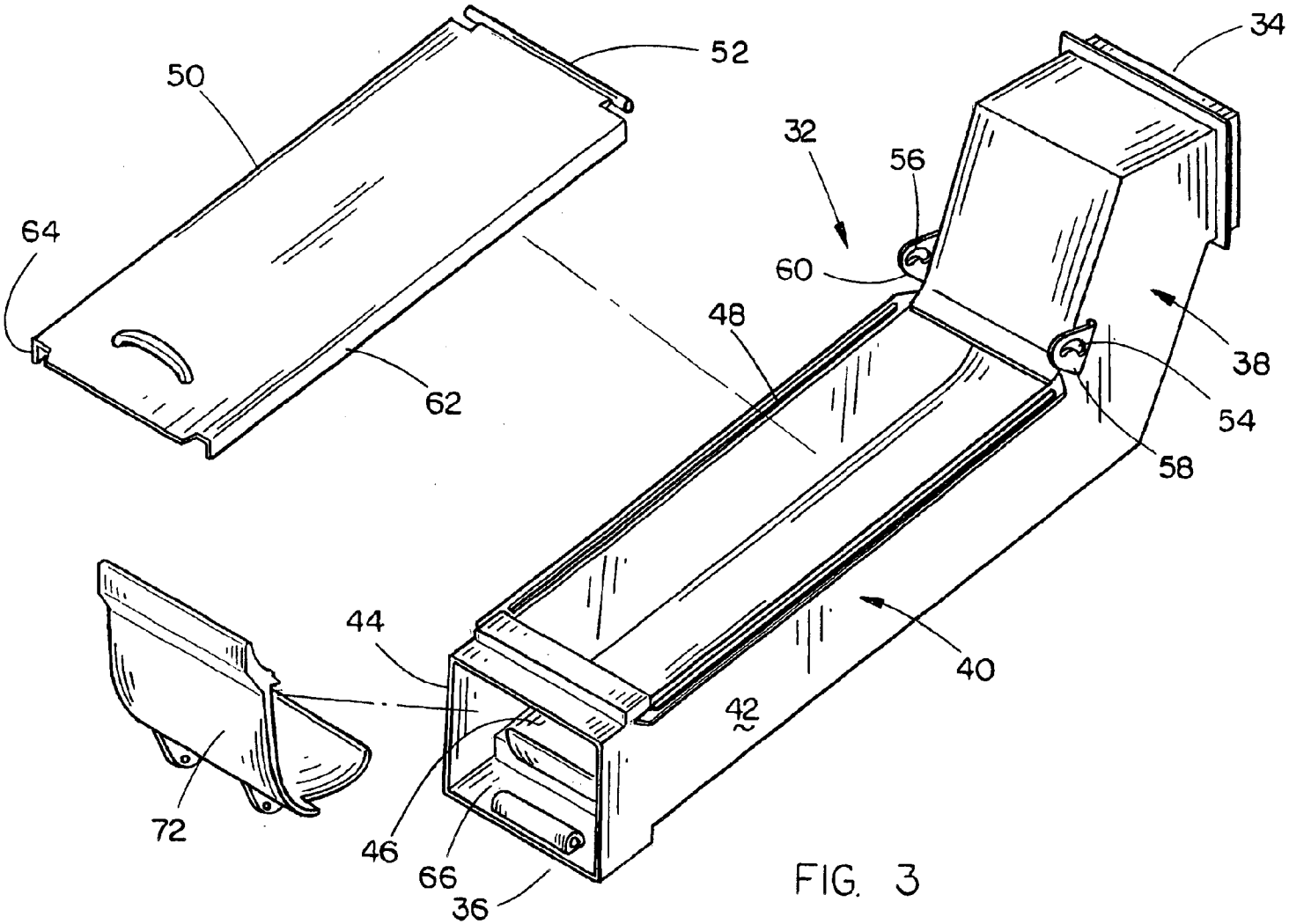
FIG. 3 is an exploded perspective view of the can dispensing structure of this invention.
Figure 4:
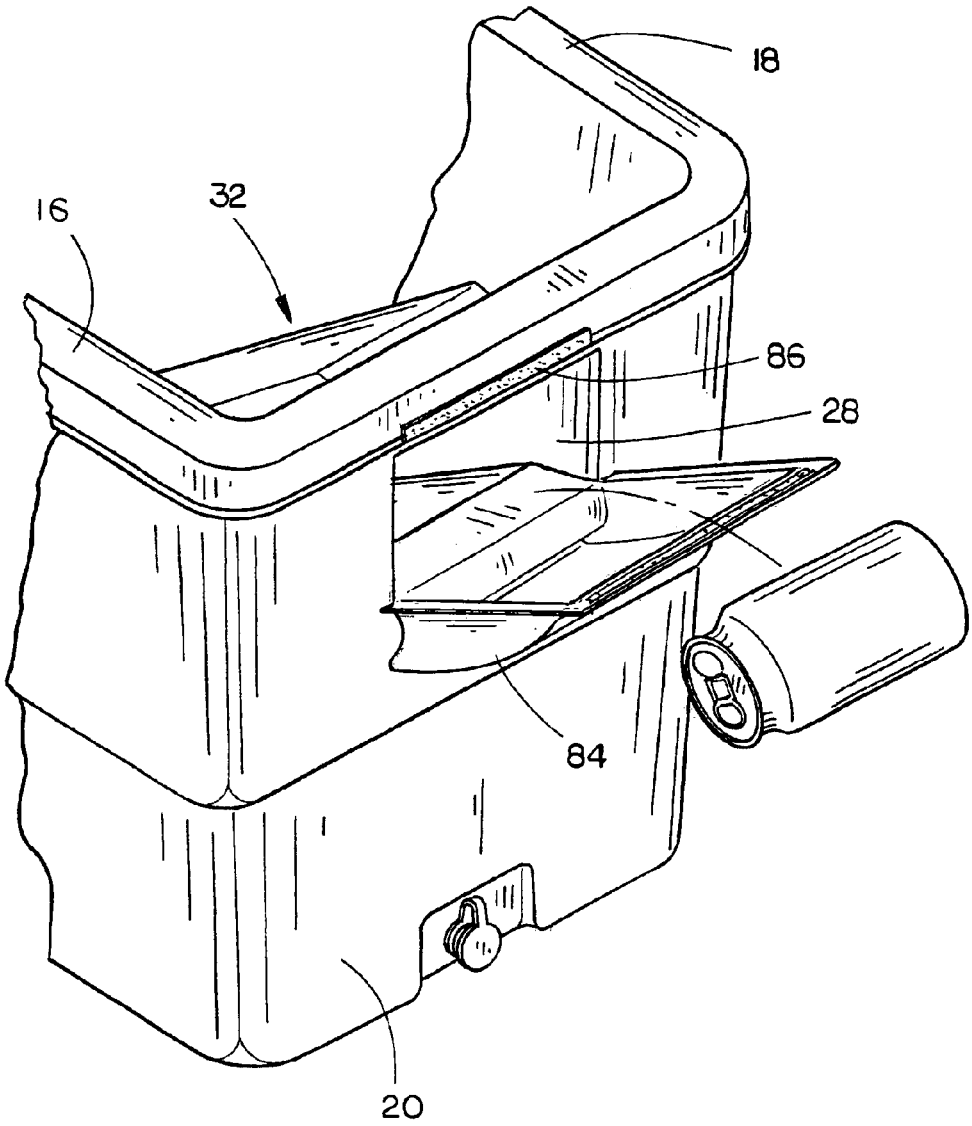
FIG. 4 is a partial perspective view of the cooler chest and can dispensing structure of this invention illustrating the manner in which a beverage can is inserted into one end of the structure.

For purposes of description, the main body portion 40 of structure 32 will be described as including side walls 42 and 44, bottom wall 46 and an upper open end 48 which is selectively closeable by a cover or lid 50. Lid 50 includes a pin or rod 52 at one end thereof which is pivotally received by slots 54 and 56 in ears 58 and 60 secured to the chute portion 38, as seen in FIG. 3. Cover 50 includes downwardly extending side portions 62 and 64 which are designed to sealably close the open upper end 48 of the body portion 40 to prevent ice and water in the cooler compartment from entering the interior of the structure 32. The cover 50 is provided to enable the interior of the structure 32 to be cleaned should a can leak while positioned within the structure 32. Although the cover 50 is preferred, the structure 32 will satisfactorily perform its intended function without a cover 50.

Figure 5:
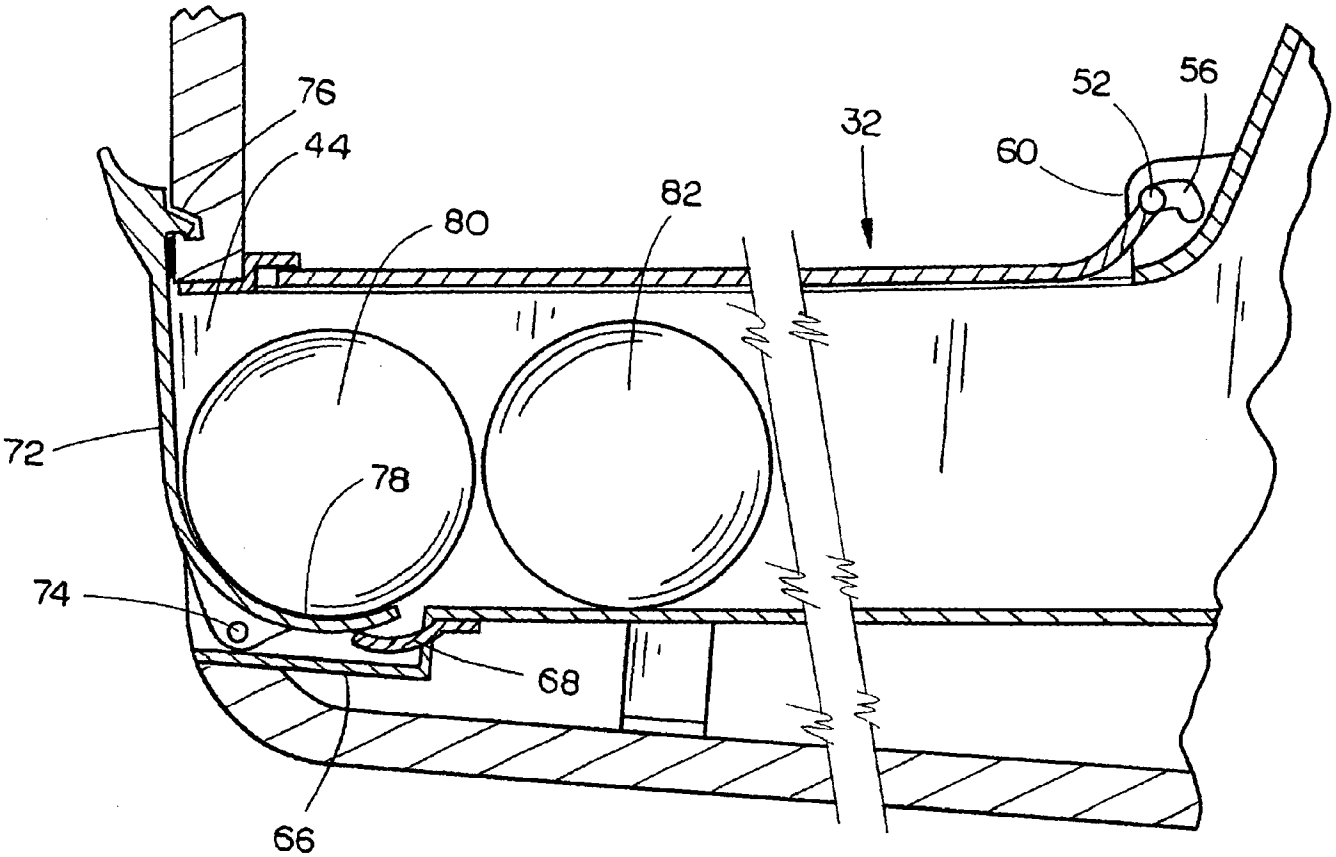
FIG. 5 is a vertical sectional view of the dispensing end of the can dispensing structure.
Figure 6:
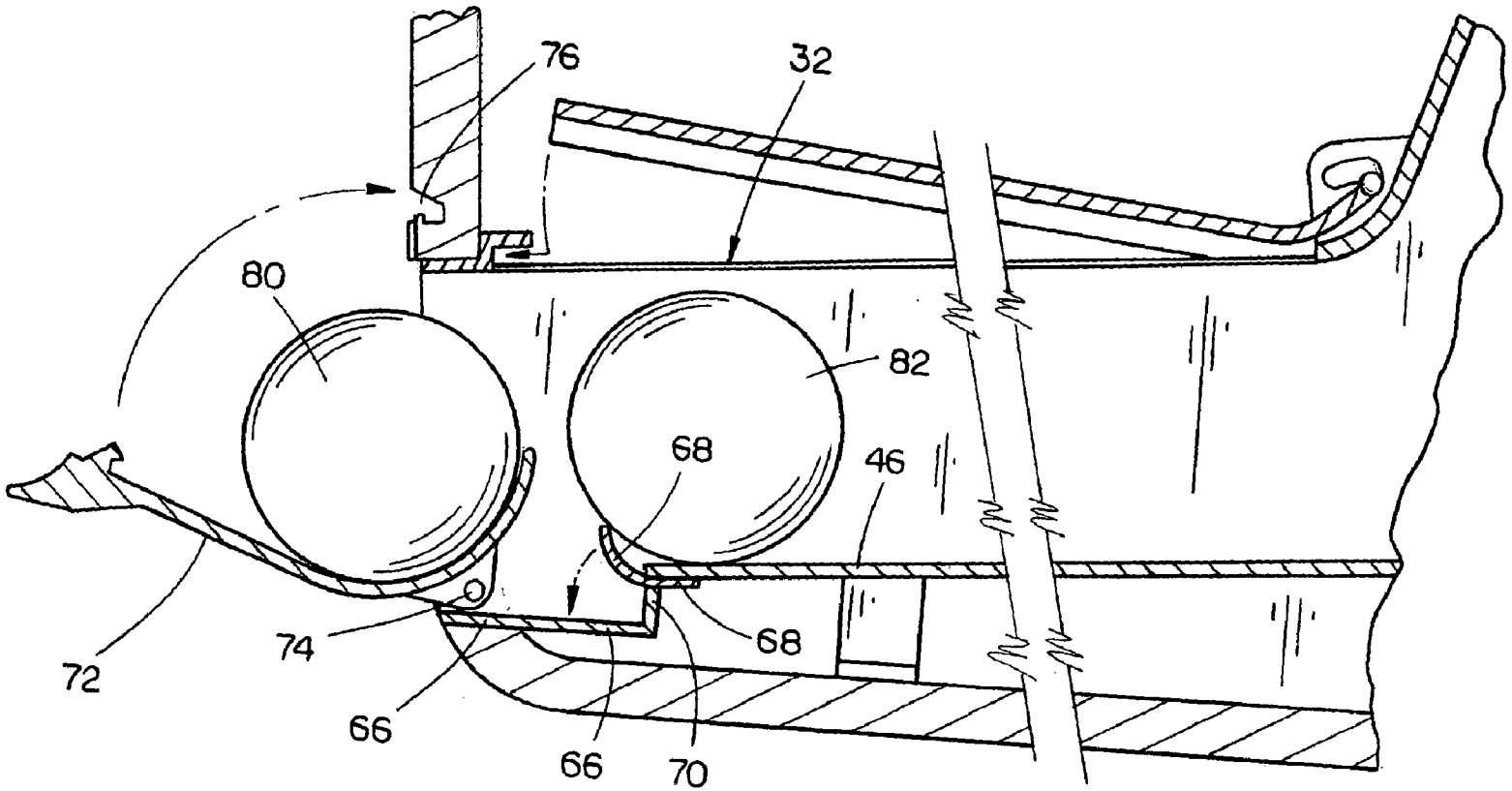
FIG. 6 is a view similar to FIG. 5 but which illustrates the manner in which a cooled can is dispensed therefrom.
Figure 7:
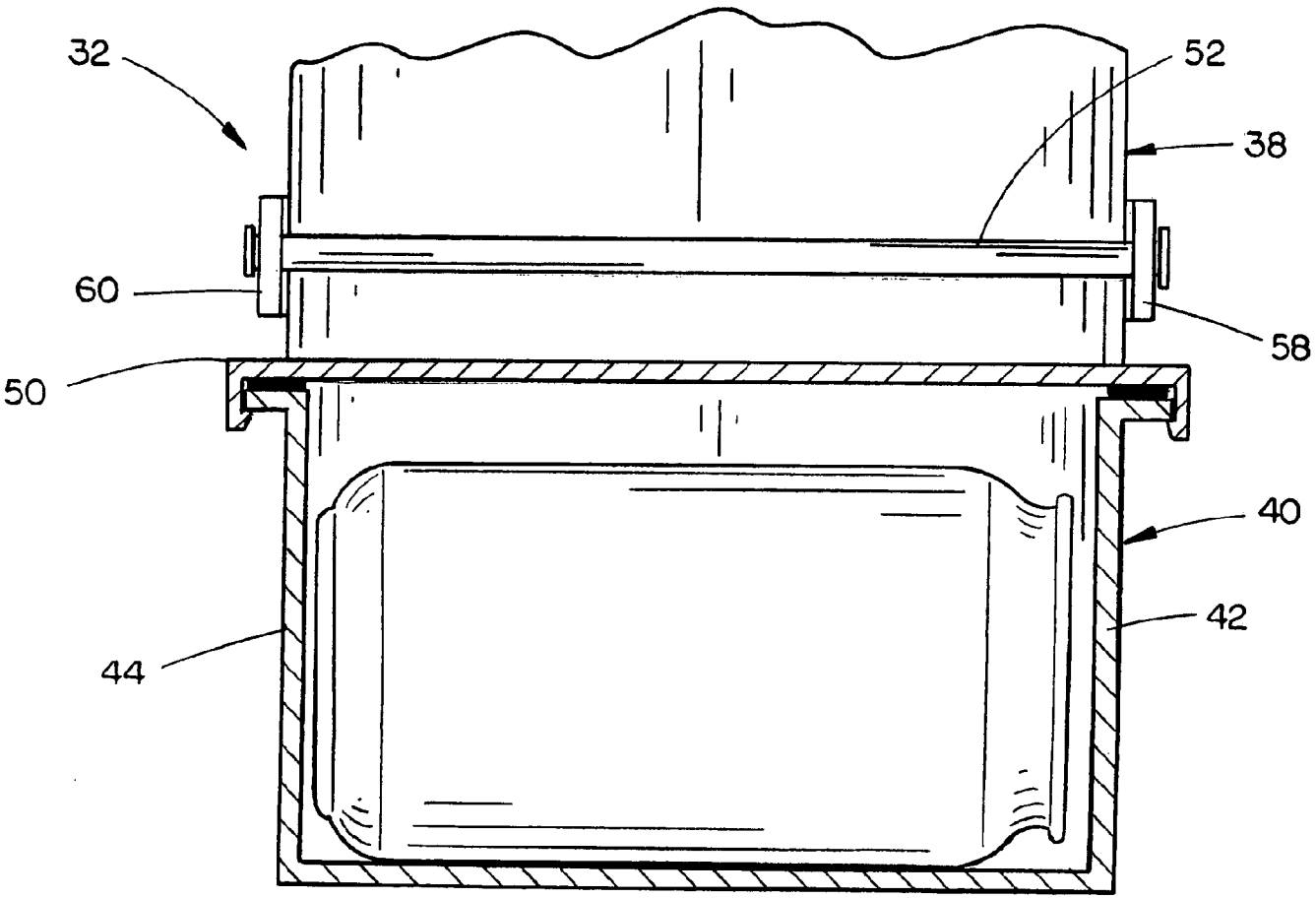
FIG. 7 is a vertical sectional view of the can dispensing structure of this invention.

The discharge end of bottom wall 46 has a stepped-down wall portion 66, as best seen in FIGS. 3 and 6. Arcuate spring 68 is positioned in the shoulder 70 extending between the bottom wall 46 and the wall portion 66 and is normally in the position illustrated in FIG. 6. An arcuate door selectively closes rectangular opening 30, as seen in FIG. 5, and is pivotally connected to the wall portion 66 at 74. The upper end of cover 72 is adapted to be selectively received in the opening 76 formed in end wall 22 to selectively close and seal the opening 30. When the cover 72 is closed, as illustrated in FIG. 5, the arcuate portion 78 supports a beverage can 80, as illustrated in FIG. 5, and causes the spring 68 to be moved to the position illustrated in FIG. 5. When the cover 72 is pivotally moved to the position of FIG. 6 from the position of FIG. 5, the spring 68 moves upwardly to engage the next can 82 to be dispensed, as illustrated in FIG. 6, to prevent that can from being dispensed from the structure 32. Opening of the cover 72 from the position of FIG. 5 to the position of FIG. 6 causes a single beverage can to be dispensed from the interior of the cover 72.

The discharge end or dispensing end of the structure 32 is sealed within the opening 30 to prevent water and/or ice in the cooler compartment from leaking from the interior of the cooler compartment of the chest (FIG. 5). Similarly, the inlet end 34 of the structure 32 is sealed within the opening 28 to prevent water and/or ice from leaking from the interior of the chest. The opening 28 is selectively sealably closed by means of a cover 84 which is hingedly secured to end wall 20 at its lower end and which is sealed to the exterior surface of the end wall 20 by means of a Velcro mechanism 86.

In operation, the cooler chest 12 is filled with ice by simply opening the lid 26 to the position illustrated in FIG. 1 and filling the interior compartment of the cooling chest with ice. The lid 26 is then closed and will remain closed until it is desired to replenish the ice supply within the chest 12. Once the ice has been placed in the interior of the chest 12, the beverage cans are inserted into the structure 32 by opening the cover 84 and inserting the beverage cans into the inlet end of the structure 32 until the interior thereof is filled with the cans. The ice and water within the chest surrounds the structure 32 and will cool the cans therein without the ice or water in the chest coming into contact therewith thereby preventing contamination of the cans. When it is desired to remove a can from the structure 32, the cover 72 is pivotally moved from the position of FIG. 5 to the position of FIG. 6 which causes a single can to be dispensed from the chest, as previously described. When the can 82 has been removed from the structure 32, the cover 72 is then moved to the position of FIG. 5 so that another can moves downwardly into the dispensing position of the structure 32.

The structure of this invention prevents ice and water from coming into contact with the cans while they are being cooled, thereby preventing contamination thereof as stated above. Further, the structure of this invention prevents ice and water from leaking from the inlet end and the discharge or dispensing end of the structure 32. Beverage cans may be successively inserted into the inlet end of the structure 32 by simply opening the lid 84 and inserting a can through the rectangular opening 28. The cans within the structure 32 move by gravity from the inlet or receiving end to the discharge or dispensing end.

It can therefore be seen that a novel cooler chest and can dispensing structure has been provided which accomplishes at least all of its stated objectives.

I claim:

1. A cooler chest and can dispenser structure operable to individually dispense cans therefrom, comprising:

a cooler chest including a bottom wall, upright spaced-apart first and second side walls, and upright spaced-apart first and second end walls which define a cooler compartment which is selectively closed by a lid member;

said first end wall of said cooler chest having a generally horizontally disposed first rectangular opening formed therein below the upper end thereof;

said first rectangular opening being selectively closeable;

said second end wall of said cooler chest having a generally horizontally disposed second rectangular opening formed therein above the lower end thereof;

and a can dispenser structure positioned in said cooler compartment which extends between said first and second end walls of said cooler chest;

said can dispenser structure having a can receiving end in communication with said first rectangular opening;

said can dispenser structure having a can dispensing end in communication with said second rectangular opening;

said can dispenser structure including a can cooling compartment which is sealed from said cooler compartment of said cooler chest so that ice and water in said cooler compartment cannot enter said can cooling compartment;

said can dispensing structure being enclosed except for its said can receiving end and its said can dispensing end so that ice and water in said cooler compartment cannot enter the interior of said can dispensing structure;

said can dispensing structure including a selectively openable top wall to permit access to the interior thereof for cleaning purposes.

* * * * *